US006439857B1

(12) United States Patent
Koelzer et al.

(10) Patent No.: US 6,439,857 B1
(45) Date of Patent: Aug. 27, 2002

(54) AXIAL PISTON COMPRESSOR

(75) Inventors: Robert L. Koelzer, Kearney; Andrew W. Adams, Less's Summit, both of MO (US); Mark D. Schaake, Bonner Springs, KS (US); Michael R. Jenkins, Kansas City, MO (US)

(73) Assignee: Haldex Brake Corporation, Kansas City, MO (US)

( * ) Notice: Subject to any disclaimer, the term of this patent is extended or adjusted under 35 U.S.C. 154(b) by 0 days.

(21) Appl. No.: 09/804,013

(22) Filed: Mar. 12, 2001

(51) Int. Cl.[7] ..... F04B 1/26

(52) U.S. Cl. ..... 417/222.1; 417/269; 417/270; 92/71; 91/504

(58) Field of Search ..... 417/222.1, 269, 417/270; 92/71; 91/504

(56) References Cited

U.S. PATENT DOCUMENTS

| | | | | | |
|---|---|---|---|---|---|
| 4,368,928 | A | | 1/1983 | Billingsley et al. | |
| 4,886,423 | A | | 12/1989 | Iwanami et al. | |
| 5,241,822 | A | * | 9/1993 | Pecnik et al. | 417/222.1 |
| 5,393,204 | A | * | 2/1995 | Kawahara | 184/6.16 |
| 5,394,698 | A | | 3/1995 | Takagi et al. | |
| 5,626,463 | A | | 5/1997 | Kimura et al. | |
| 6,095,760 | A | * | 8/2000 | Houtman | 417/218 |
| 6,095,761 | A | | 8/2000 | Kanai et al. | |
| 6,102,490 | A | * | 8/2000 | Ko | 303/10 |
| 6,120,259 | A | * | 9/2000 | Miyaji et al. | 417/222.1 |
| 6,146,110 | A | * | 11/2000 | Higashihara et al. | 29/888.042 |
| 6,162,024 | A | * | 12/2000 | Bruzek | 417/218 |
| 6,176,684 | B1 | * | 1/2001 | Zimmermann | 417/222.1 |
| 6,247,901 | B1 | | 6/2001 | Unger | 417/223 |

* cited by examiner

*Primary Examiner*—Charles G. Freay
*Assistant Examiner*—Emmanuel Sayoc
(74) *Attorney, Agent, or Firm*—St. Onge Steward Johnston &Reens LLC

(57) ABSTRACT

An axial piston compressor produces air supplied to an air system of a vehicle, typically a heavy duty truck through a plurality of pistons held within a stationary block, and the movement of the pistons is predicated through the control of a pivotal swash plate. The pistons are idle in a neutral position of the swash plate, wherein a pressure above the pistons in the cylinder block counterbalances a thrust generated by an actuator upon the plate positioned in a plane extending perpendicular to a drive shaft. The plate oscillates in response to a pressure drop above the pistons causing the actuator to expand toward the plate and exert a thrust exceeding the lowered pressure above the pistons and enabling the swash plate to provide the pistons with reciprocal motion.

20 Claims, 6 Drawing Sheets

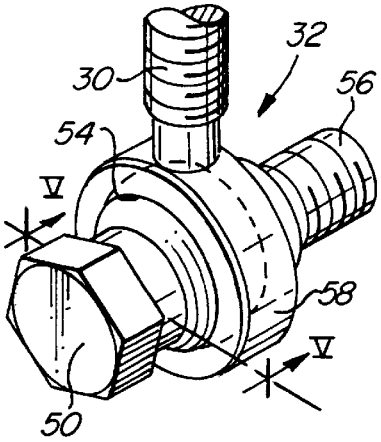
FIG. 4
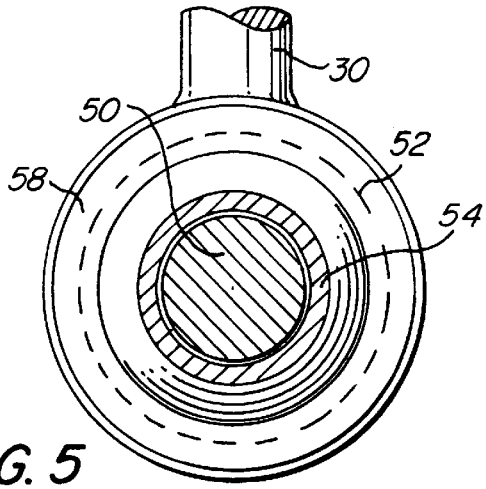
FIG. 5
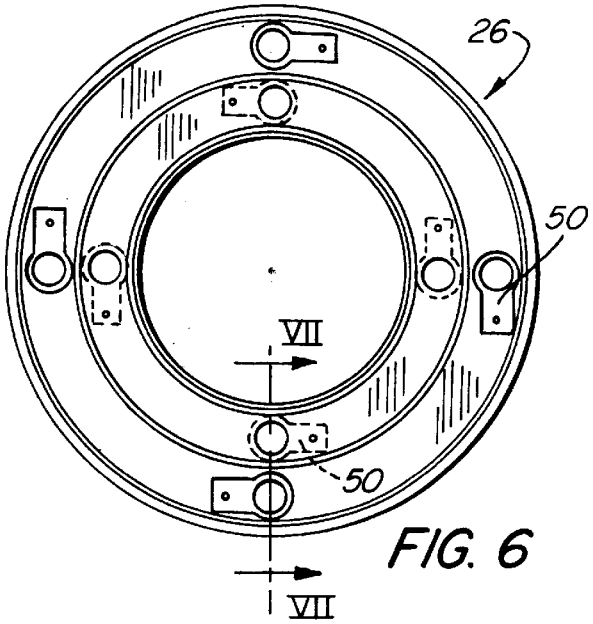
FIG. 6
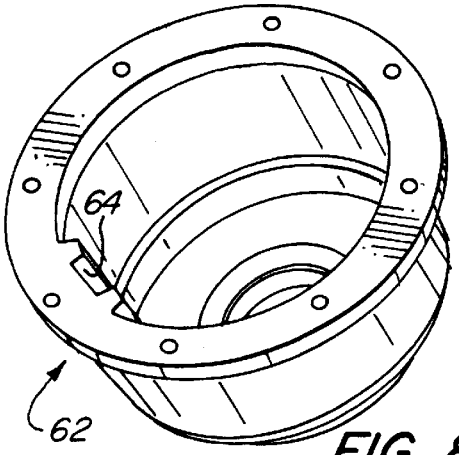
FIG. 8
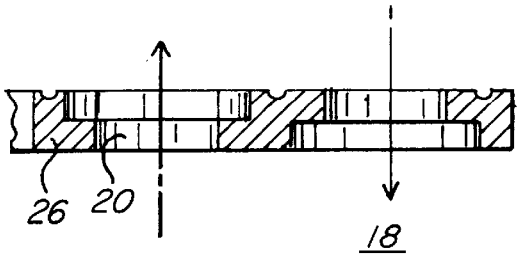
FIG. 7
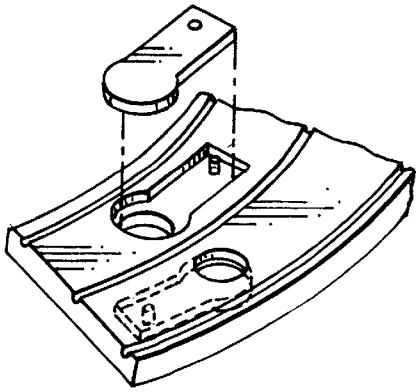

AXIAL PISTON COMPRESSOR

FIELD OF THE INVENTION

The invention relates to an axial piston compressor used in the automobile industry to generate compressed air for a variety of accessories employed in a motor vehicle. Particularly, the invention relates to a variable displacement swash-plate air compressor installed on a vehicle and having pistons the motion of which is predicated on displacement of a swash plate.

BACKGROUND OF THE INVENTION

A swash-plate axial piston compressor is disclosed on U.S. Pat. No. 5,626,463 to Kimura et al. Typically used as air-conditioning compressors, this type of compressor is known for its complicated mechanical construction which includes at least one movable piston in a cylinder block. The piston conveys the air to be compressed from an intake region into a compression region. The reciprocating action of the piston is effected by a swash plate, which is rotatably mounted on a rotating shaft.

The swash plates acts in conjunction with a take-up plate linked to at least one piston, the plate being positioned in the compressor housing such that it cannot rotate and is supported on a non-rotatable thrust bearing. The purpose of the thrust bearing is to take up the torque that is transmitted from the rotating swash plate to the take-up plate. Compressors of this type are of complex construction in the regions of swash and take-up plates, involving a large number of parts. Furthermore, the discussed compressors require a relatively large space.

Another construction of the swash-plate axial piston type compressor includes a rotatable cylinder block and a stationary swash plate and is disclosed for example in U.S. Pat. No. 5,384,698 to Takagi et al. This structure is also structurally complex and in addition tends to permit oil leakage into the air stream.

It is, therefore, desirable to provide a variable displacement swash-plate air compressor with stationary bores receiving pistons. Also, it is desirable to provide an axial piston compressor wherein an assembly for displacing a swash plate is compact and structurally simple. Furthermore, a variable swash-plate air compressor having pistons the reciprocal motion of which is predicated on displacement of a swash plate is also desirable.

SUMMARY OF THE INVENTION

In accordance with the invention, a swash plate of an axial piston compressor moves between a neutral position, wherein forces from the air pressure inside the cylinders and a movable cam acting in opposite directions upon the plate are counterbalanced to cease compression of compressed air, and a second pressurizing position, with the preloading selected at a level below which the air pressure needs to be increased.

Accordingly, the inventive axial piston compressor has a displaceable actuator, which exerts a thrust upon a swash plate to displace pistons in stationary bores of the cylinders. The compressor ceases air-compression when a thrust exerted by an actuator upon the swash plate counterbalances a force generated by pistons upon the swash plate. Thus, the compressor experiences a state of pressure equilibrium, wherein the swash plate lies in a plane extending perpendicular to a shaft supporting the swash plate, and the pistons are idle. The force generated by the pistons is a result of air pressure above the pistons in the stationary cylinder block which is in flow communication with an air system of a motor vehicle, including, but not limited to, a heavy-duty truck.

The compressor is in a working state characterized by reciprocal motion of the pistons after the actuator controllably moves towards and pivots the swash plate in response to a pressure drop in the cylinder block below the thrust generated by the actuator in the state of equilibrium.

In accordance with one aspect of the invention, the actuator includes a plurality of resilient elements attached to a cam element which is in contact with the swash plate. The resilient elements are able to expand at a distance toward the swash plate in response to a pressure drop in the air system of the vehicle which causes the pressure in the space above the pistons to decrease below the thrust generated by the resilient elements. Pistons' strokes are controlled by an angle at which the swash plate deflects from its vertical or neutral position by a thrust generated by the cam, which is displaced by the expanded washers as the pressure in the air system drops to or below a reference value that is equal to a force generated by the washers in the neutral state of the plate. The swash plate will shift back to the neutral position, wherein the pistons are neutralized, thus discontinuing air production upon reaching the state of equilibrium between the force generated by the washers and the pressure above the pistons.

In accordance with another aspect of the invention, the angle at which the swash plate deflects from its neutral positions is controlled by a servo piston, which may be mounted in a rotating member of a drive shaft. The servo piston is attached to a link coupled to a cam element which is displaced toward the plate at distance corresponding a signal actuating the servo piston and corresponding to a pressure drop in the air system of the vehicle.

It is, therefore, an object of the invention to provide an axial piston compressor having a swash plate controlling the movement of the pistons, which are received in stationary cylinder bores.

Yet another object of the invention is to provide an axial piston compressor wherein the angular displacement of the swash plate is controlled in response to displacement of an actuator after the pressure in an air system of the truck has fall down to or below a reference value.

Still a further object of the invention is to provide an axial piston compressor having a resilient actuator which is controllably displaced relative to the swash plate in order to exert a thrust upon the plate in response to the pressure change in the air system.

A further object of the invention is to provide an axial piston compressor wherein air production is initiated upon disturbing a state of equilibrium, wherein a force exerted by a controllably displaceable cam element upon a swash plate is counterbalanced by a pre-set pressure in the air system of the truck.

BRIEF DESCRIPTION OF THE DRAWINGS

The above and other objects, features and advantages will become more readily apparent from the following detailed description of the invention illustrated by the following drawings, in which:

FIG. 4 is an isometric view of a ball link connecting the pistons with a swash plate.

FIG. 5 is a cross-sectional view of the ball link of FIG. 4 taken along lines V—V.

FIG. 6 is plane view of a head plate of the compressor shown in FIG. 1.

FIG. 7 is a sectional view of the head plate of FIG. 6 taken along lines VII—VII.

FIG. 8 is an isometric view of a compressor housing enclosing the swash plate.

DETAILED DESCRIPTION OF THE DRAWINGS

Figure 1:
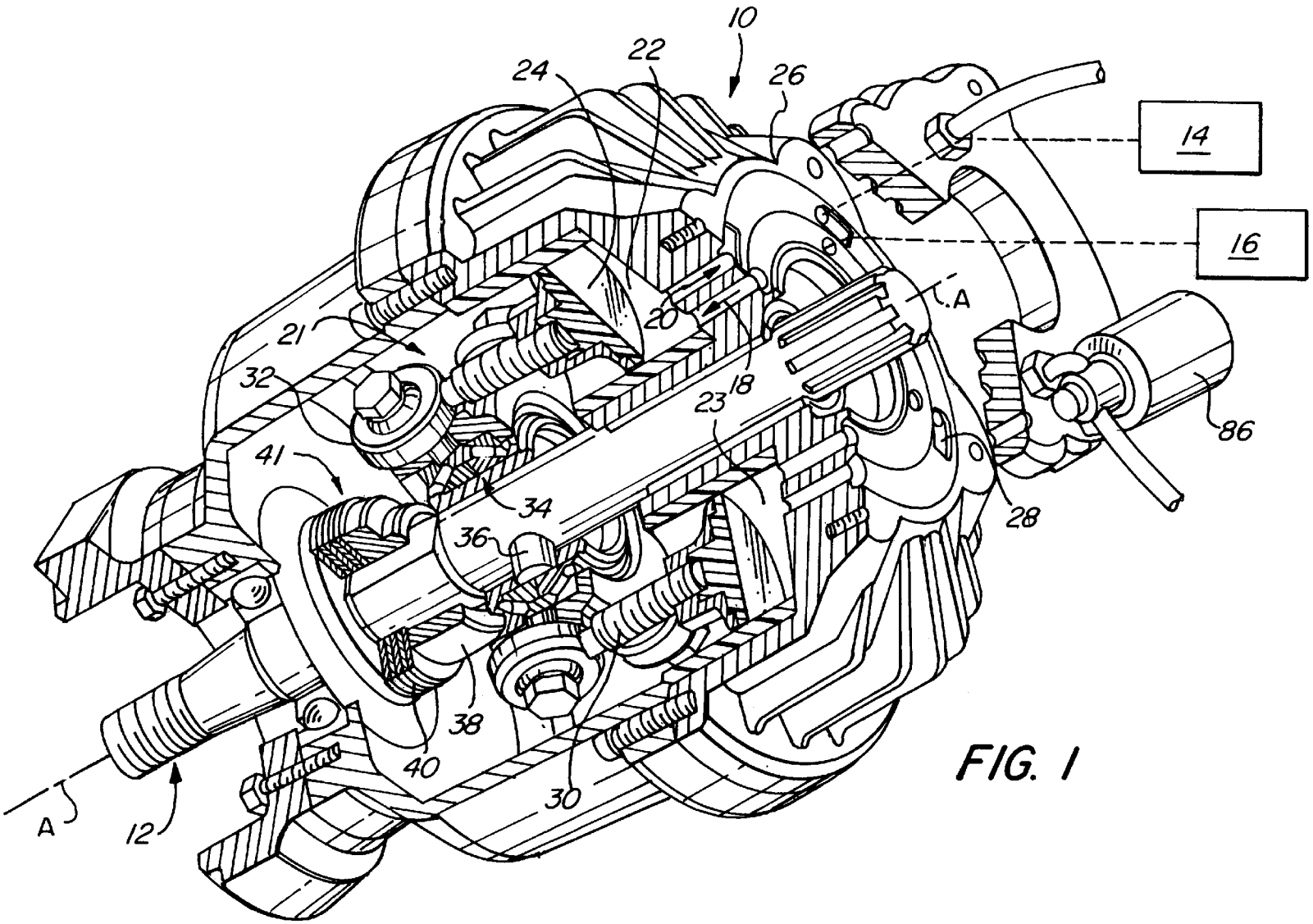
FIG. 1 is an isometric view of the axial piston compressor provided with a swash plate in accordance with the invention.
Figure 2:
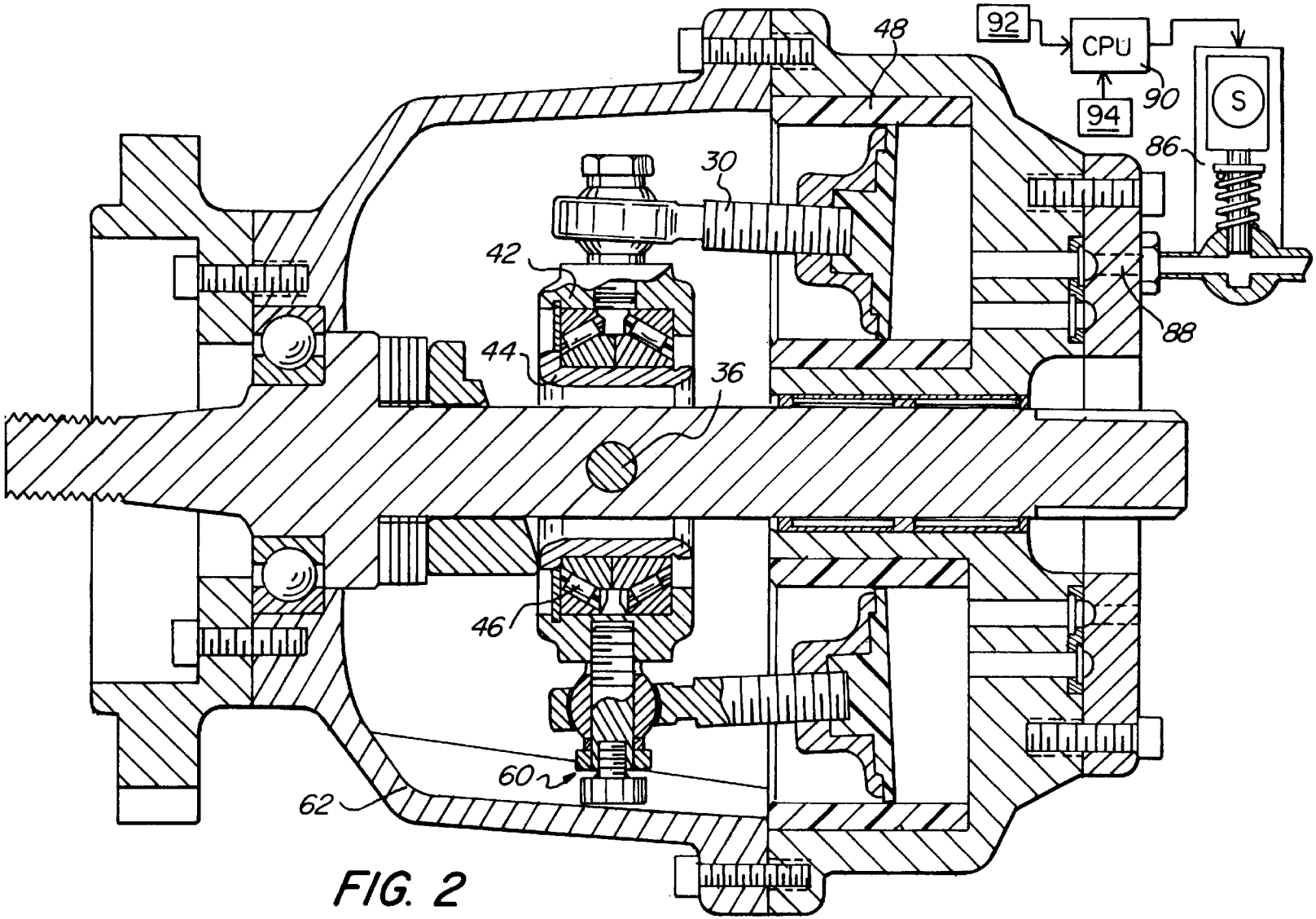
FIG. 2 is a sectional view of the compressor of FIG. 1 taken along an axis of rotation and shown in a state of equilibrium, wherein the pistons are immovable.
Figure 3:
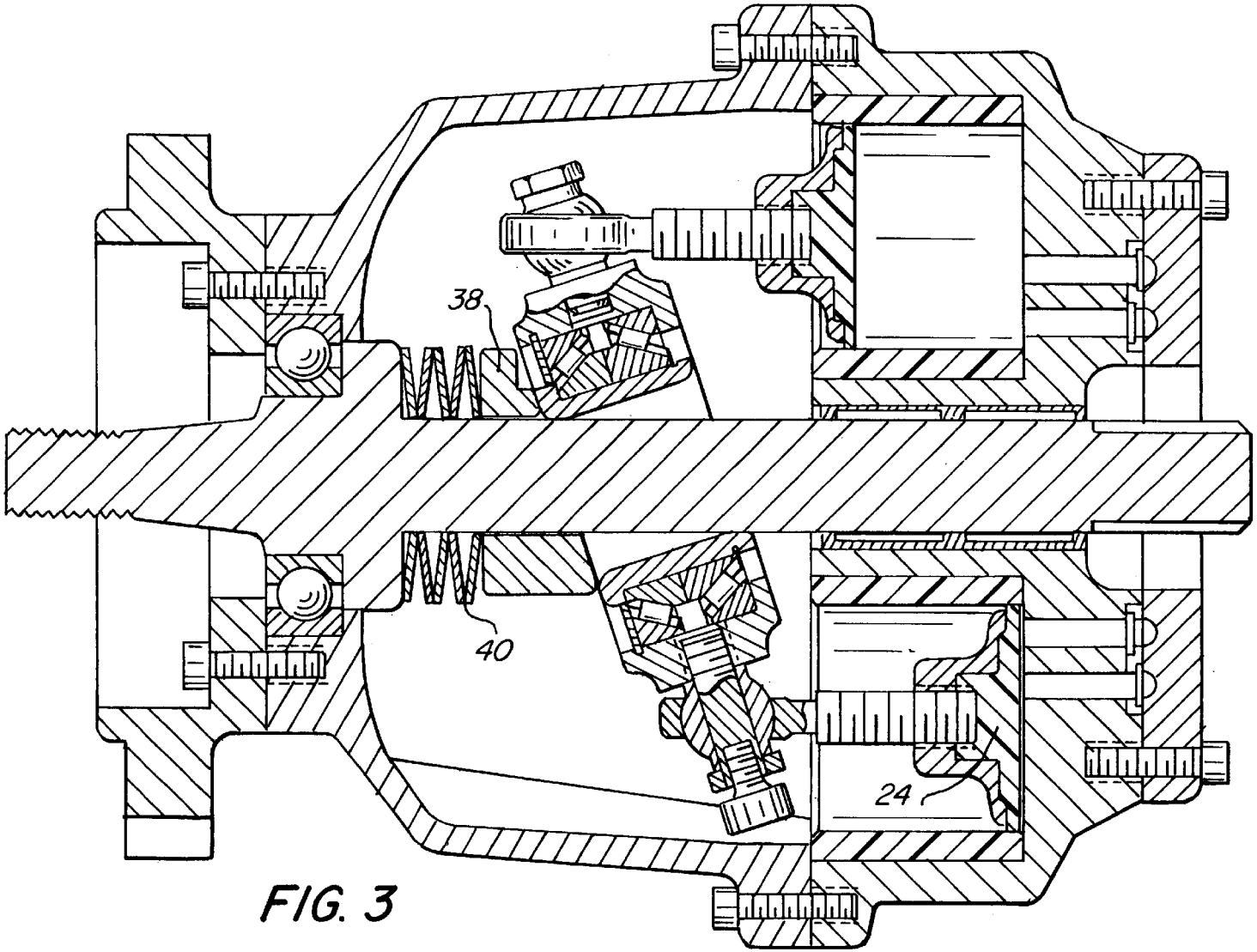
FIG. 3 is a sectional view of the compressor of FIG. 1 showing the pistons being actuated.

Referring to FIGS. 1–3, a variable displacement swash-plate compressor 10 installed on a heavy duty vehicle, such as an over-the road truck, generates compressed air for the truck's air pressure system which includes a tank 14 supplying the compressed air to various accessories, for example the brake system. Production of the compressed air begins by taking in air, which may or may not be delivered from a turbocharger or through a filter 16, in response to reduction of the air pressure in the air system to or below a reference pressure, which may vary from 10 Bar for North America to 13 Bar for Europe.

To provide the compressed air, the compressor 10 has a stationary cylinder block 22 including a plurality of bores 23 which receive pistons 24 reciprocally displaceable within the bores to have suction and compression strokes. A space in cylinder bores above the pistons is in flow communication with the air system through a plurality of discharge ports 20. Accordingly, the air pressure in this space corresponds to air pressure in the air system in a state of pressure equilibrium of the compressor, as is explained below.

The pistons are idle in the state of pressure equilibrium wherein a piston-generated force acting upon a swash plate assembly 34 and corresponding to the air pressure in the space above the pistons is equal and oppositely directed to a thrust generated by an actuating assembly 41 against this plate assembly. The state of equilibrium is characterized by a substantially perpendicular position of the swash plate assembly with respect to an axis of a rotating shaft 12. Once the balance of air pressure has been disturbed, the thrust from the actuating assembly exceeds the lowered piston-generated force to angularly displace the swash plate assembly from its perpendicular position. As a result, the pistons begin to reciprocally move in the stationary bores, as will be explained in detail hereinbelow. Thus, the more the air pressure in the air system drops, the larger the angular displacement of the swash plate is and the longer the pistons' strokes are.

To provide flow communication between the intake and discharge ports 18, 20, the compressor has a head plate 26, as better illustrated in FIGS. 6 and 7, which is provided with a plurality of check valves 28 preventing the back feeding of the air discharge. Preferably, the check valves may be of reed or poppet types allowing air to flow along a path from a high-pressure area to a low-pressure area. Thus, as the pressure in the air system downstream from the compressor lowers, airflow is directed from the bores to the air system through the valve 28 provided in the discharge port 20. Accordingly, air pressure above the pistons is lowered causing thus displacement of the actuating assembly 41, the swash plate and the pistons. As a result, the suction stroke generates a negative pressure sufficient to allow outer air to enter the cylinder block through valves 28 provided in the inlet port 18.

Note, although the pistons' motion is arrested, and, thus, the compressor does not compress air, the shaft continues to rotate. As a consequence, accessories coupled to the shaft, such as a fuel pump, continue to function.

Figure 9:
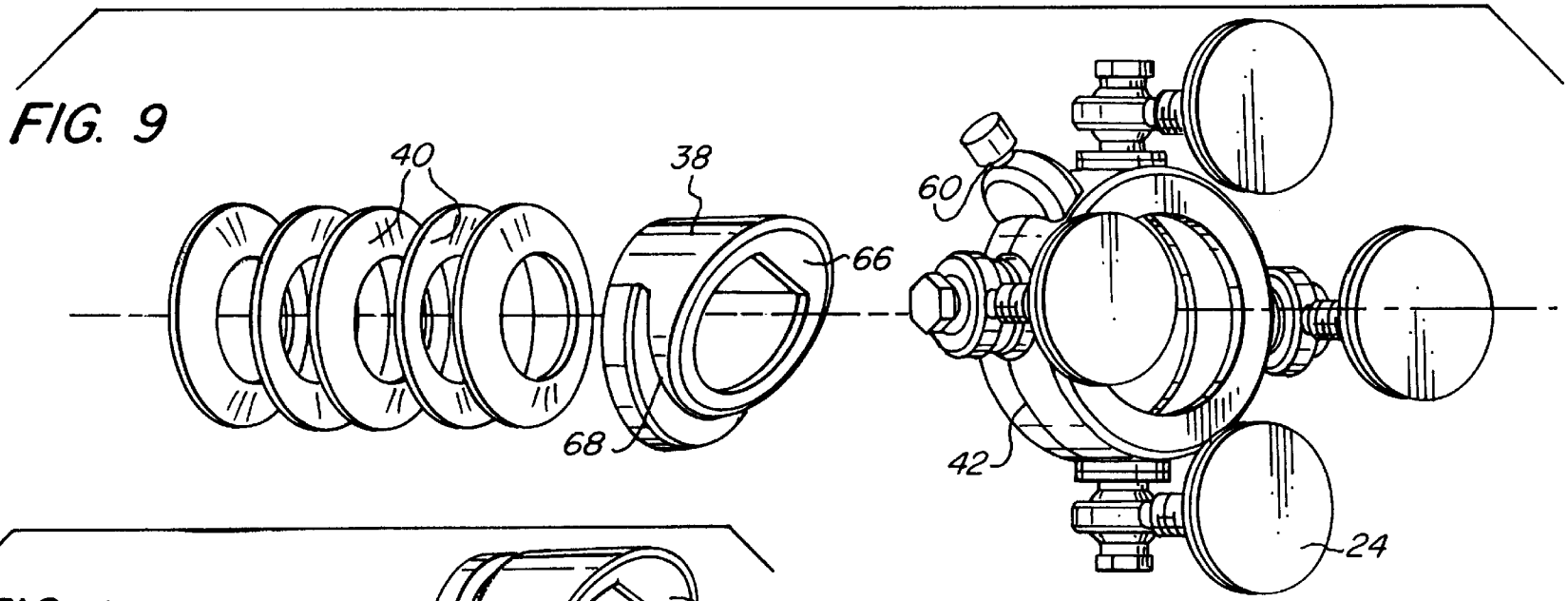
FIG. 9 is an exploded perspective view of the swash plate and a swash plate actuating mechanism.
Figure 10:
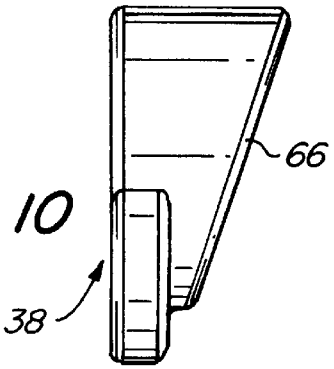
FIG. 10 is a side view of a cam collar of the swash plate actuating mechanism.

In accordance with one aspect of the invention, the actuating assembly includes a resilient element, such as Belleville washers 40 and a cam collar 38, as shown in detail in FIG. 9. The washers are connected to the cam collar 38 having a slanted cam surface with respect to the shaft, an extended part 66 of which is always in contact with the swash plate 34. Note, the swash plate is always under pressure existing above the pistons and thus, to maintain the plate in the vertical position during the state of equilibrium, the cam collar has to continuously preload the plate. However, this contact in the state of equilibrium does not generate a thrust sufficient to overcome the pressure above the pistons and to pivot the plate about a pin 36 rotatably mounted on the shaft 12.

Although the actuating assembly as shown is rotatably mounted on the shaft 12, it can be stationary mounted to a housing 62 of the compressor. Further, different types of compression springs, such as bellows, can be used as effectively as the above-disclosed washers.

The swash plate assembly 34 is comprised of a rotatable inner part 44 coupled to the pin 36 to rotate about a shaft axis A—A of the shaft 12, and an outer part 42 better illustrated in FIGS. 2 and 9 and connected to the inner part by means of a bearing assembly 46. The entire swash plate assembly is pivotal with respect to the shaft upon a thrust exerted by the cam collar 38 which moves axially along the shaft in response to the expansion of the Belleville washers as the pressure in the air system drops to or below the reference value.

A mechanism for translating pivotal displacement of the swash plate (FIG. 4) to reciprocal axial displacement of the pistons (FIG. 4) includes a plurality of ball links, each of which is comprised of a ball element 54 and a rod 56. The rods 56, which are spaced angularly equidistantly from one another along an outer periphery of the swash plate and extend radially therefrom, can be for example bolts provided with a thread on one of its ends and with a nut 50 on the opposite end. The ball 54 has a spherical outer surface slidably engaging a piston rod 30, which extends parallel to the rotating shaft 12, for synchronous axial displacement, while allowing the piston rod and ball element to angularly displace relative to one another.

To displace the pistons and swash plate relative to one another as the swash plate pivots, each piston rod 30 has a flange 58 the inner surface of which cooperates with an outer extremity 52 of the ball element, as shown in FIG. 5. Accordingly, as the swash plate is angularly displaced to a position shown in FIG. 3, the cooperating surfaces of the flange and ball element slidably move relative to one another. Such relative displacement allows the piston rod and ball element 54 to move axially together, while the ball element rotates within the flange in response to the angular motion of the swash plate. Note that the flange 58 may have its cooperating surface provided with a shape different from an annular shape as long as these elements move axially synchronously while being angularly displaceable relative to one another, as shown in FIG. 3 FIG. 3 illustrates a working mode of the compressor wherein the washers 40 have expanded in response to the pressure drop in the air system to or below the reference value. As a result, the cam collar is axially displaced to pivot the swash plate whose movement generates the suction and compression strokes of the pistons.

To prevent the outer part 42 of the swash plate assembly from rotating, the swash plate receives a radially extending stopper 60 which engages an axial groove 64 of the housing 62, as seen in FIG. 8. The groove is defined between two axial ribs extending from an inner surface of the housing toward the swash plate. The groove and the stopper are so dimensioned that the stopper's head does not slide out of engagement with groove even if the plate is maximally displaced from its neutral position, as shown in FIG. 3. Note that rods 30, 56 and stopper 60 can be all threaded, and thus can be easily assembled or replaced.

Figure 11:
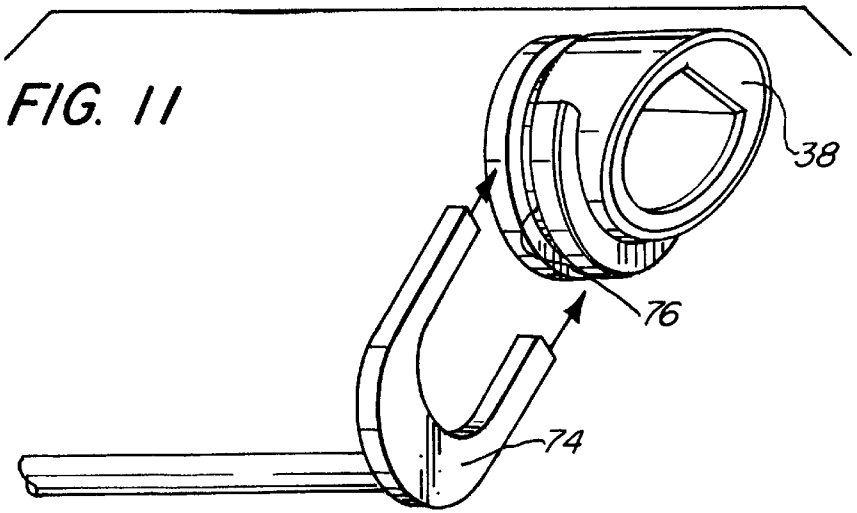
FIG. 11 is an isometric view of another embodiment of the swash plate actuating mechanism.
Figure 12:
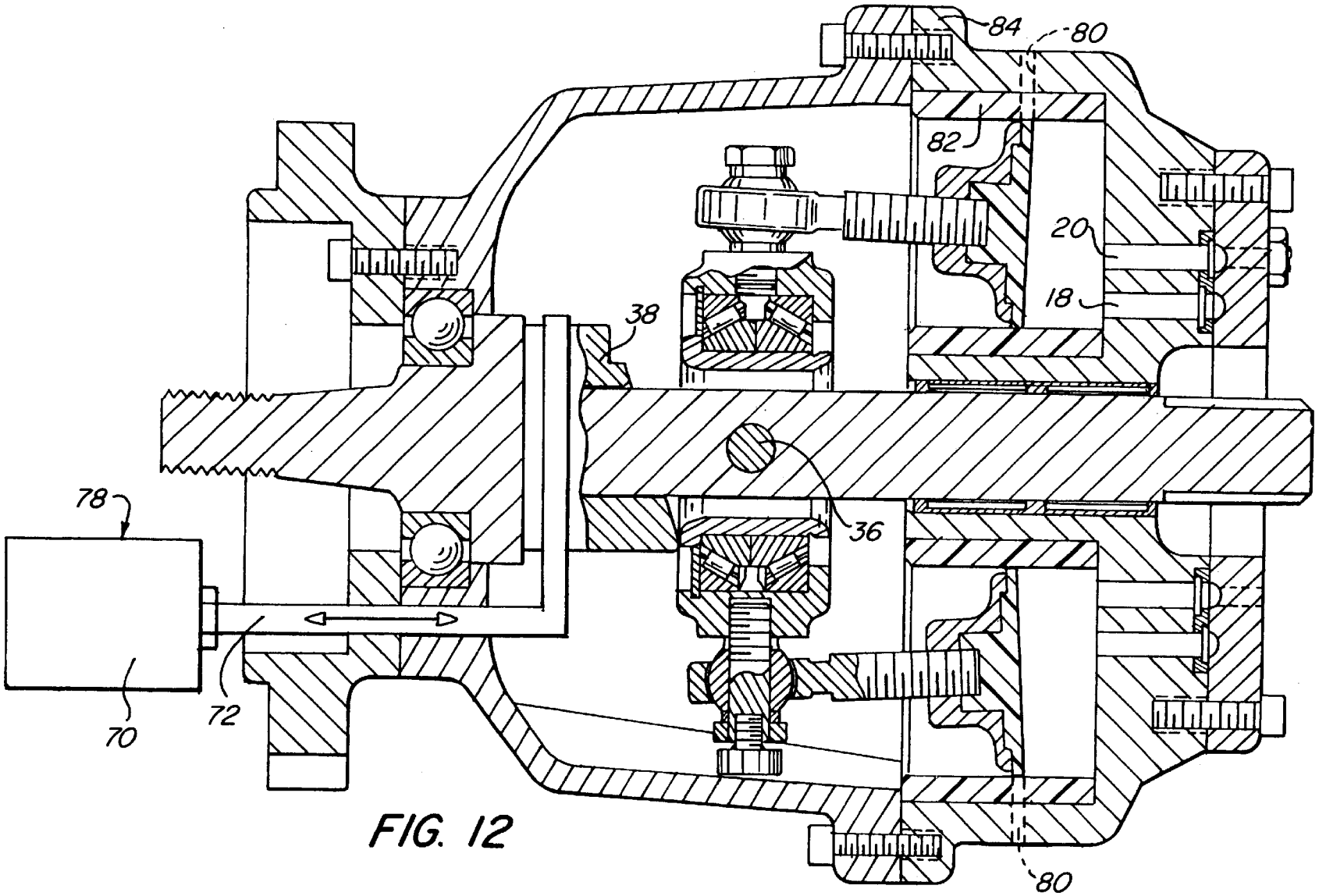
FIG. 12 is an isometric view of the axial piston compressor provided with the swash plate actuating mechanism of FIG. 11.

In accordance with another aspect of the invention, the actuating assembly 41 shown in FIGS. 11 and 12 includes a servo piston 70 which can be housed within the compressor housing, but for the illustrative purposes is shown outside the housing. The servo piston is actuated in response to a pilot signal generated by an external source 78, which may be pneumatic, hydraulic, or electrical. The pilot signal represents the reference value of the air system's pressure and is generated once the pressure falls down to or below the threshold.

The servo piston is attached to a mechanical link 72, 74 such as a fork, which is connected to the cam collar 38. As a result of displacement of the servo piston, the fork displaces the cam collar which exerts a thrust sufficient to pivotally displace the swash plate from its neutral position and cause the pistons to reciprocate. Upon reaching the desirable pressure in the air system, the servo piston is brought in its initial position corresponding to the vertical position of the swash plate with respect to the axis of the shaft.

In accordance with this embodiment, a radially extending air inlet 80 is provided in a head plate 84 and a cylinder block 82 made of heat resistant material. The pistons are idle in the state of equilibrium and are in a position wherein they block the air inlet, preventing thus the entry of outside air. As the oscillating swash plate displaces the pistons, the air inlet opens allowing the outer air to be drawn into the bores above the piston heads, which during the compression stroke deliver the compressed air to the air system through the discharge port 20.

As shown in FIGS. 2 and 12, to temporarily release the engine of the truck from an additional load under certain conditions, such as when a truck climbs up a steep hill, a solenoid 86 can close the discharge port 88 upon an on-demand signal from a driver. As a result, the pressure above the pistons in the cylinder block rapidly rises enabling the compressor to reach the state of equilibrium within a short period of time. Opening of the solenoid allows the compressor to return to a normal mode of operation.

In addition, as shown in FIG. 2, a vehicle is provided with a central processing init 90 receiving for example a signal, which is generated by a pressure sensor 92 after air pressure in the air system has reached a predetermined high threshold. Once this signal is processed, the solenoid is actuated to block the discharge port.

Furthermore, the central processing unit 90, which is typically a computer, is able to process a signal 94 indicating the overall load on the vehicle's engine. Thus, if a signal indicative of the load exceeds a certain threshold, the processing unit generates a pilot signal actuating the solenoid, which closes up the discharge port. In this case, the compressor rapidly achieves the state of equilibrium, as explained above, and stops compressing air.

Since the reciprocal motion of the pistons is arrested after the state of equilibrium is reached, the need in lubrication between the pistons and the head of the compressor is reduced. As a consequence, oil passage into the air stream is also reduced. Furthermore, to minimize the effects of oil passage on the air stream even further, the cylinder bores and piston cups are coated with wear-resistant materials. Thus, piston cups are associated with a material selected from the group including a PTFE material filled with bronze and Molybdenum Disulfide and a PTFE material filled with graphite and PPS. Anodized aluminum coating (close to 60RC hardness) is applied to the surfaces of the cylinder bores. In fact, the proper selection of coating materials along with the controllable motion of the pistons can lead to a structure in which lubrication between the pistons and the head of the compressor is not necessary.

Although the invention has been described with reference to a particular arrangements of parts, features and the like, these are not intended to exhaust all possible arrangements or features, and indeed many other modifications and variations will be ascertainable to those of skill in the art.

What is claimed is:

1. An axial piston compressor for supplying compressed air to an air system upon lowering the pressure in the air system to or below a reference value comprising:

an elongated drive shaft extending between opposite ends along an axis;

a cylinder block mounted on one end of the shaft and having spaced apart cylinder bores surrounding the shaft and being in flow communication with the air system;

pistons slidably received in the cylinder bores;

a swash plate pivotally mounted on the shaft and connected to the pistons; and an actuator axially spaced from the cylinder block and displaceable along the other end of the shaft in response to a pressure change in the air system between a first position, wherein the actuator exerts a thrust upon the swash plate equal at least to the reference value to support the swash plate in a plane perpendicular to the shaft and to keep the pistons idle, and a second position, wherein the thrust exerted by the actuator exceeds the lowered pressure of the air system to pivotally displace the swash plate relative to the shaft and to cause the reciprocal motion of the pistons in the cylinder bores.

2. The axial piston compressor defined in claim 1 wherein the actuator includes a resilient element attached to a cam collar in contact with the swash plate.

3. The axial piston compressor defined in claim 2 wherein the resilient element is Belleville washers.

4. The axial piston compressor defined in claim 1 wherein the actuator is rotatably mounted on the shaft.

5. The axial piston compressor defined in claim 2 wherein the resilient element and cam collar are stationary with respect to the shaft.

6. The axial piston compressor defined in claim 1, wherein the swash plate has an inner part and an outer part attached to one another to synchronously pivot about the shaft having a shaft axis.

7. The axial piston compressor defined in claim 6, wherein the swash plate has a bearing assembly between the inner and outer parts to enable the parts to rotate relative to one another about the shaft axis, the axial compressor further comprising a pin, which has a pin axis extending perpendicular to the shaft axis, the pin being rotatably fixed to the inner part of the swash plate assembly and mounted on the shaft to rotate therewith.

8. The axial piston compressor defined in claim 6 wherein the swash plate oscillates about the pin axis in response to the thrust generated by the cam collar upon the inner part of the swash plate in the second position of the actuator.

9. The axial piston compressor defined in claim 1, further comprising a housing provided with an axial groove, the swash plate having a radially extending stopper slidably engaging the axial groove of the housing to prevent rotation of the outer part about the shaft axis as the swash plate oscillates in the second position of the actuator.

10. The axial piston compressor defined in claim 1, further comprising a plurality of ball links spaced apart on the swash plate and extending radially outwardly to engage the pistons.

11. The axial piston compressor defined in claim 10 wherein the ball link includes a ball body traversed by a link rod.

12. The axial piston compressor defined in claim 10 wherein the piston includes a piston rod extending generally parallel to the shaft and having an end provided with a flange which surrounds the ball body to allow relative angular displacement between the ball body and the piston rod as the swash plate oscillates.

13. The axial piston compressor defined in claim 1, further comprising a head plate surrounding the one end of the shaft and provided with a plurality of axial inlet ports traversed by intake air as the pistons perform the suction stroke and a plurality of axial discharge ports, the discharge ports being in flow communication with the air system and traversed by airflow from the cylinder block during the compression stroke of the pistons.

14. The axial piston compressor defined in claim 13 wherein the head plate has a plurality of check valves selected from the group consisting of poppet and reed valves and communicating with the inlet and outlet ports, the check valves provided in the outlet ports are open upon lowering the pressure in the air system below the preset value to allow airflow from the cylinder block to the air system.

15. The axial piston compressor defined in claim 1 wherein the actuator is displaceable at a variable distance in the second position depending on the air pressure change in the air system and defining the length of axial strokes of the pistons.

16. The axial piston compressor defined in claim 13, further comprising a solenoid valve provided with a piston capable of blocking the discharge port upon an on-demand signal.

17. The axial piston compressor defined in claim 1 wherein the actuator includes a servo piston, which is actuated in response to the drop of pressure in the air system at most below the reference value, and a fork, which is attached between the servo piston and a cam, the cam being in contact with and exerting the thrust upon the swash plate.

18. The axial piston compressor defined in claim 17, further comprising the a radial inlet port for incoming airflow provided in the cylinder block and blocked by the pistons in the first position of the actuator.

19. An axial piston compressor comprising:

a drive shaft rotatable about a shaft axis;

a swash plate pivotally mounted on the shaft to pivot about a pivot axis which extends perpendicular to the shaft axis;

a cylinder block with a plurality of bores surrounding a one end of the shaft;

a plurality of pistons engaged with the swash plate and received in the bores, the pistons exerting a force upon the swash plate in response to air pressure in the cylinder block above the pistons;

an axially movable cam surrounding the opposite end of the shaft and preloading the swash plate, the swash plate being pivotal between a neutral position, wherein forces from the air pressure in the cylinder block and the movable cam acting in opposite directions upon the plate are counterbalanced to cease compression of air, and a second pressurizing position, with the preloading selected at a level below which the air pressure needs to be increased.

20. The axial piston compressor defined in claim 19 further comprising an actuator selected from the group consisting of Belleville washers and a servo piston, each connected to the cam to move it between the first and a plurality of second positions in response to pressure drop below a reference value which is equal to the thrust generated by the cam in the first position.

* * * * *